US008069003B2

(12) United States Patent
Friedrich et al.

(10) Patent No.: US 8,069,003 B2
(45) Date of Patent: Nov. 29, 2011

(54) MONITORING OF HEAT EXCHANGERS IN PROCESS CONTROL SYSTEMS

(75) Inventors: Michael Friedrich, Frankfurt (DE); Herbert Grieb, Malsch (DE); Thomas Müller-Heinzerling, Stutensee (DE); Bernd-Markus Pfeiffer, Wörth (DE); Michael Schüler, Frankfurt (DE)

(73) Assignee: Siemens Aktiengesellschaft, Munich (DE)

( * ) Notice: Subject to any disclaimer, the term of this patent is extended or adjusted under 35 U.S.C. 154(b) by 267 days.

(21) Appl. No.: 12/474,310

(22) Filed: May 29, 2009

(65) Prior Publication Data

US 2010/0036638 A1 Feb. 11, 2010

(30) Foreign Application Priority Data

May 29, 2008 (EP) ..... 08009815

(51) Int. Cl.
*G01K 17/06* (2006.01)

(52) U.S. Cl. ..... 702/136

(58) Field of Classification Search ..... 702/50, 702/81, 130, 35, 132, 136, 182, 183, 185; 374/43, 112

See application file for complete search history.

(56) References Cited

U.S. PATENT DOCUMENTS

| | | | | |
|---|---|---|---|---|
| 3,918,300 | A * | 11/1975 | Weisstuch et al. | 73/113.01 |
| 5,181,482 | A | 1/1993 | Labbe et al. | |
| 5,399,017 | A * | 3/1995 | Droege | 374/7 |
| 5,607,008 | A * | 3/1997 | Niederer | 165/11.1 |
| 6,736,089 | B1 | 5/2004 | Lefebvre et al. | |
| 2008/0183427 | A1 * | 7/2008 | Miller | 702/183 |

FOREIGN PATENT DOCUMENTS

| | | | |
|---|---|---|---|
| DE | 19502096 | A1 | 7/2009 |
| WO | 2008014514 | A1 | 1/2008 |

OTHER PUBLICATIONS

Zölzer et al., "Einsatz des Kessel-Diagnose Systems KEDI im Kraftwerk Staudinger 5", Sep. 1995, pp. 759-762, XP 525900A, vol. 9.

* cited by examiner

*Primary Examiner* — Mohamed Charioui
*Assistant Examiner* — Paul D Lee

(57) ABSTRACT

A method for monitoring the efficiency of a heat exchanger is provided. Heat flows from a first medium into a second medium and an actual heat flow is detected and compared with at least one reference heat flow corresponding to a respectively predetermined degree of soiling of the heat exchanger. Furthermore, a device for controlling a plant having at least one heat exchanger is described. The plant has a storage device storing at least one reference heat flow of the heat exchanger.

12 Claims, 2 Drawing Sheets

MONITORING OF HEAT EXCHANGERS IN PROCESS CONTROL SYSTEMS

CROSS REFERENCE TO RELATED APPLICATIONS

This application claims priority of European Patent Application No. 08009815.5 EP filed May 29, 2008, which is incorporated by reference herein in its entirety.

FIELD OF INVENTION

The invention relates to a method for monitoring the efficiency of a heat exchanger in which heat flows from a first medium into a second medium. The invention also relates to a device for controlling a plant having at least one heat exchanger.

SUMMARY OF INVENTION

Heat exchangers are technical apparatuses in which for example liquids at a first temperature dissipate a portion of their heat to liquids at a second temperature that is below the first temperature for example. Thus for example a first medium (product medium) can be cooled or heated by means of a second medium (service medium). The service medium can for example be cooling water or heating steam. The service medium conventionally flows either through a pipeline arrangement, which is disposed inside the product medium, or flows around the pipeline arrangement through which product medium flows.

Deposits can form (what is known as fouling) inside or outside the pipeline arrangement as a function of the nature of the product medium or service medium. The efficiency of the heat exchanger is reduced by the deposits. If the thickness of the deposits has exceeded a certain amount it is necessary to clean the pipeline arrangement therefore. The relevant heat exchanger usually has to be put out of commission for this purpose. This is very complex on the one hand and involves significant costs on the other.

A particular drawback is that the deposits are often not visible from the outside. Therefore it is not possible to discern when cleaning is required. Cleaning is frequently only carried out if problems caused by the poor efficiency of the heat exchanger occur. To avoid this, the heat exchanger must be cleaned at regular intervals as a precaution. This is also disadvantageous as in such a case the heat exchanger is then cleaned even if the deposits are still not very heavy.

Simulation programs are known which are used for the process-engineering design and dimensioning of heat exchangers in the planning phase of a plant and which are based on physical-thermodynamic modeling of the heat exchanger which is numerically divided into numerous segments for this purpose, but use of these simulation programs for online monitoring of heat exchangers while they are operating is not known. Until now there has therefore been no satisfactory solution to the monitoring of heat exchangers within a process control system, in particular if the heat exchangers are operated at different working points in the operating phase because for example flow or temperature of the product are not constant.

It is an object of the invention to design a method mentioned in the introduction and a controller mentioned in the introduction in such a way that a conclusion can be drawn about the efficiency of a heat exchanger.

The object is solved by a method as claimed in the independent claim. Advantageous developments of the invention result from the dependent claims.

According to the invention a method for monitoring the efficiency of a heat exchanger, in which heat flows from a first medium into a second medium, is characterized in that an actual heat flow is detected and compared with at least one reference heat flow corresponding to a respectively predetermined degree of soiling of the heat exchanger.

Furthermore, according to the invention a device for controlling a plant having at least one heat exchanger is characterized in that a storage device exists in which at least one reference heat flow of the heat exchanger is stored.

As a result of the fact that an actual heat flow is detected and compared with at least one reference heat flow corresponding to a respectively predetermined degree of soiling of the heat exchanger a very reliable conclusion may be drawn about the efficiency of the heat exchanger because as a result of the inventive idea of using the heat flow itself as a measure of the efficiency of the heat exchanger, a quantity is used as a measure of the efficiency of the heat exchanger which represents the most significant function of the heat exchanger. Consequently problems which can occur with indirect determination of the efficiency of the heat exchanger, i.e, when a different quantity characterizing the heat exchanger is used to determine the efficiency thereof, are removed.

The actual heat flow ($\dot{Q}_{act}$) can be determined by detecting the flow ($F_P$) of product medium through the heat exchanger, the flow ($F_S$) of service medium through the heat exchanger, the temperature ($T_{P,In}$) of the product medium at the entry of the product medium into the heat exchanger, the temperature ($T_{P,Out}$) of the product medium at the exit of the product medium from the heat exchanger, the temperature ($T_{S,In}$) of the service medium at the entry of the service medium into the heat exchanger and the temperature ($T_{S,Out}$) of the service medium at the exit of the service medium from the heat exchanger. Using the measured values of the flows and the temperatures as well as the material data $c_{P,P}$, $c_{P,S}$, $\rho_P$ and $\rho_S$ the actual heat flow for a liquid-liquid heat exchanger may be reliably and easily calculated from the steady energy balances for product and service media inside the heat exchanger according to the following formulae:

$$\dot{Q}_P = c_{P,P} \cdot \rho_P \cdot F_P \cdot (T_{P,Out} - T_{P,In})$$

$$\dot{Q}_S = c_{P,S} \cdot \rho_S \cdot F_S \cdot (T_{S,Out} - T_{S,In})$$

In theory the following applies owing to the law of conservation of energy:

$$\dot{Q}_P = -\dot{Q}_S$$

A mean of the absolute values is formed for the actual heat flow owing to measuring inaccuracies:

$$\dot{Q}act = \frac{1}{2} \cdot (|\dot{Q}_P| + |\dot{Q}_S|)$$

wherein $\dot{Q}_P$ is the heat flow of the product medium, $\dot{Q}_S$ is the heat flow of the service medium, $\dot{Q}_{act}$ is the actual heat flow, $c_{P,P}$ is the thermal capacity of the product medium, $c_{P,S}$ is the thermal capacity of the service medium, $\rho_P$ is the density of the product medium und $\rho_S$ is the density of the service medium.

If cases of evaporation or condensation of product or service medium in the heat exchanger these formulae must be adapted accordingly.

A respective theoretical heat flow, which can be used as the reference heat flow, may be calculated for different degrees of soiling of the heat exchanger by means of the process-engineering simulation program with which the heat exchanger was designed or can be designed or can be dimensioned.

The reference heat flow is advantageously calculated by means of the simulation program. Consequently reference heat flows are easily obtained which come very close to the actual heat flows of the relevant heat exchanger with the same boundary conditions. To increase the accuracy, measurements are taken at a few working points when the heat exchanger is clean to fine tune parameters of the simulation program.

By comparing the actual heat flow with the reference heat flow determined with the simulation program, for example when the heat exchanger is not dirty, a reliable conclusion may be drawn about the actual efficiency of the heat exchanger. If the actual heat flow matches the reference heat flow the efficiency of the heat exchanger is not impaired by deposits. As the difference between the actual heat flow and the reference heat flow increases, the efficiency of the heat exchanger decreases, i.e. the deposits have increased. The difference between the actual heat flow and the reference heat flow therefore forms a measure of the deposits, i.e. the soiling of the heat exchanger. The greater the difference is, the greater the deposits are.

Instead of comparing the actual heat flow with the reference heat flow of the heat exchanger which is not dirty, the actual heat flow can be compared with the reference heat flow of the dirty heat exchanger. The difference between the actual heat flow and the reference heat flow then forms a reciprocal measure of the deposits, i.e. the smaller the difference is, the greater the deposits are.

The actual heat flow is advantageously compared with a reference heat flow corresponding to a zero degree of soiling and with a reference heat flow corresponding to a maximum admissible degree of soiling. A characteristic value may thus be determined which matches the degree of soiling of the heat exchanger from 0 to 100%.

The characteristic value is advantageously determined in that the quotient is formed from the difference between the actual heat flow and the reference heat flow corresponding to the maximum admissible degree of soiling divided by the difference between the reference heat flow corresponding to the zero degree of soiling and the reference heat flow corresponding to the maximum admissible degree of soiling. If the characteristic value, which can be designated the wearing reserve, is determined according to the following formula $$HeatPerf = \left(\frac{\dot{Q}_{act} - \dot{Q}_{dirty}}{\dot{Q}_{clean} - \dot{Q}_{dirty}}\right) \cdot 100\%$$

where

HeatPerf is the characteristic value (wearing reserve), $\dot{Q}_{act}$ is the actual heat flow, $\dot{Q}_{dirty}$ is the reference heat flow when the heat exchanger is dirty and $\dot{Q}_{clean}$ is the heat flow when the heat exchanger is clean, the characteristic value when the heat exchanger is clean is 100% and when the heat exchanger is as dirty as possible is 0%. The characteristic value can be continuously calculated and is displayed as a trend over relatively long periods in the process control system in which the heat exchanger is incorporated. A maintenance message can be generated as soon as the characteristic value exceeds a specified limit.

Advantageously exactly the same working point, which for example is defined as a combination of the two flows of product medium $F_P$ and service medium $F_S$ and the two entry temperatures of product medium $T_{P,In}$ and service medium $T_{S,In}$, forms the basis of the reference heat flow as the actual heat flow. This has a very advantageous effect on the accuracy of the inventive method. Other quantities can be used for the definition of the working point if for example phase transitions (evaporation or condensation) occur within the heat exchanger.

It is particularly advantageous if a large number of reference heat flows is determined at different working points and the working point of the reference heat flow corresponding to the working point of the actual heat flow is determined by means of interpolation.

In this connection the theoretically transferable quantity of heat is firstly calculated for a large number of possible working points using the process-engineering simulation program with which the heat exchanger was for example designed or could be designed. Such simulation calculations are carried out for the reference state "freshly cleaned" and for a reference state "as dirty as possible" in which cleaning of the heat exchanger is imperative. The calculated simulation values are used as data points for two multi-dimensional characteristic diagrams respectively with a plurality of input quantities respectively (for example four input quantities respectively) and one output quantity.

Once a large number of data points has been calculated the reference heat flow for the actual working point can be inferred from the relevant characteristic diagram. If the working point is between a plurality of data points the reference heat flow for the actual working point can optionally be determined by characteristic diagram interpolation.

The time-consuming simulation calculation can advantageously be carried out offline in the run-up to operation of the process plant or heat exchanger. Then optionally only the characteristic diagram interpolation is required during operation of the process plant or heat exchanger.

A method known from mathematics is used for interpolation: first of all it is checked in which hyperbolic cube in the high-dimensional grid of the input quantities the actual working point is located. This hyperbolic cube with the simulation values of all vertices is transformed into the origin of the coordinates and normalized. The sought starting point is then calculated by evaluating a multi-linear polynomial. A method of this kind may be implemented in a controller without problems.

With an unsteady transition process between different working points the calculation is preferably temporarily frozen as the underlying model only describes the steady heat balance. To detect whether a steady state exists a method described in patent application PCT/EP2007/004745 is preferably used.

By means of the inventive method it is advantageously possible to carry out monitoring of heat exchangers with variable working points in process control systems. Direct observation of the heat flow means that auxiliary quantities, which are difficult to interpret, for determining the efficiency of the heat exchanger can be dispensed with, whereby the problems associated therewith are avoided. By using the process-engineering simulation program the working point dependency of the transferable quantity of heat can be calculated in advance for example at several hundred sampling points without corresponding time-consuming measurements having to be carried out on the real plant. Ideally the model of the heat exchanger is used several times: firstly in the planning phase for dimensioning the heat exchanger and then at the start of the operational phase to parameterize monitoring.

Storing the simulated values in a characteristic diagram means the simulation of the process-engineering model that requires a lot of calculating time can be completely omitted in the process control system. The function for online monitoring is based on a linear characteristic diagram interpolation and may be seamlessly implemented within a process control system.

The actual wearing reserve of the heat exchanger can be calculated by calculating the characteristic values for the freshly cleaned heat exchanger and the heat exchanger that is as dirty as possible. If during continuous operation it is observed that the wearing reserve is slowly moving toward zero, appropriate maintenance measures can be expediently planned, for example between two batches of a batch plant or within the framework of an otherwise planned plant stoppage in a continuously operating plant.

False alarms are avoided by freezing calculation in the case of unsteady transition processes.

BRIEF DESCRIPTION OF THE DRAWINGS

Further details, features and advantages of the present invention emerge from the following description of a particular exemplary embodiment with reference to the drawings, in which.

DETAILED DESCRIPTION OF INVENTION

Figure 1:
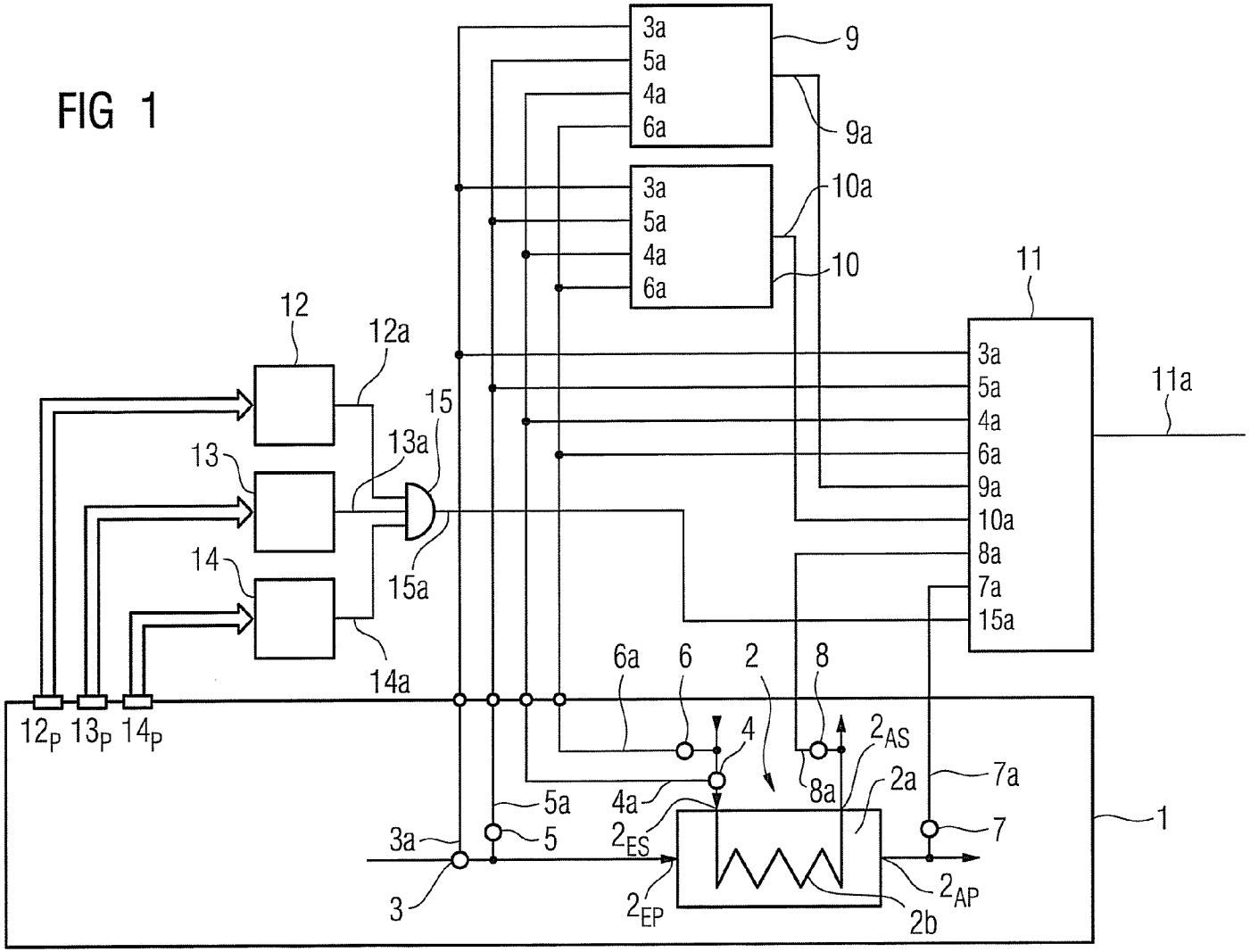
FIG. 1 shows a schematic view of a process plant having a heat exchanger, with a part of a controller relating to monitoring of the heat exchanger

As may be inferred from FIG. 1, a process plant 1 has a heat exchanger 2. The heat exchanger 2 has a receptacle 2*a* in which a pipeline arrangement 2*b* is disposed. The receptacle 2*a* has a first entrance $\mathbf{2}_{EP}$ and a first exit $\mathbf{2}_{AP}$. A product medium flows via the first entrance $\mathbf{2}_{EP}$ into the receptacle 2*a* and leaves it again at the first exit $\mathbf{2}_{AP}$.

The pipeline arrangement 2*b* is led out of the receptacle 2*a* of the heat exchanger 2 via a second entrance $\mathbf{2}_{ES}$ and via a second exit $\mathbf{2}_{AS}$. A service medium can be guided into the pipeline arrangement 2*b* via the second entrance $\mathbf{2}_{ES}$ and leaves it again at the second exit $\mathbf{2}_{AS}$.

The volume of product medium supplied to the receptacle 2*a* can be detected by means of a first flowmeter 3. The volume of service medium supplied to the pipeline arrangement 2*b* can be detected by means of a second flowmeter 4. The temperature of the product medium supplied to the receptacle 2*a* can be detected at the first entrance $\mathbf{2}_{EP}$ of the receptacle 2*a* by means of a first temperature sensor 5. The temperature of the service medium supplied to the pipeline arrangement 2*b* can be detected at the second entrance $\mathbf{2}_{ES}$ of the pipeline arrangement 2*b* by means of a second temperature sensor 6. The temperature of the product medium at the first exit $\mathbf{2}_{AP}$ of the receptacle 2*a* can be detected by means of a third temperature sensor 7.

The temperature of the service medium at the second exit $\mathbf{2}_{As}$ of the pipeline arrangement 2*b* can be detected by means of a fourth temperature sensor 8.

Figure 2:
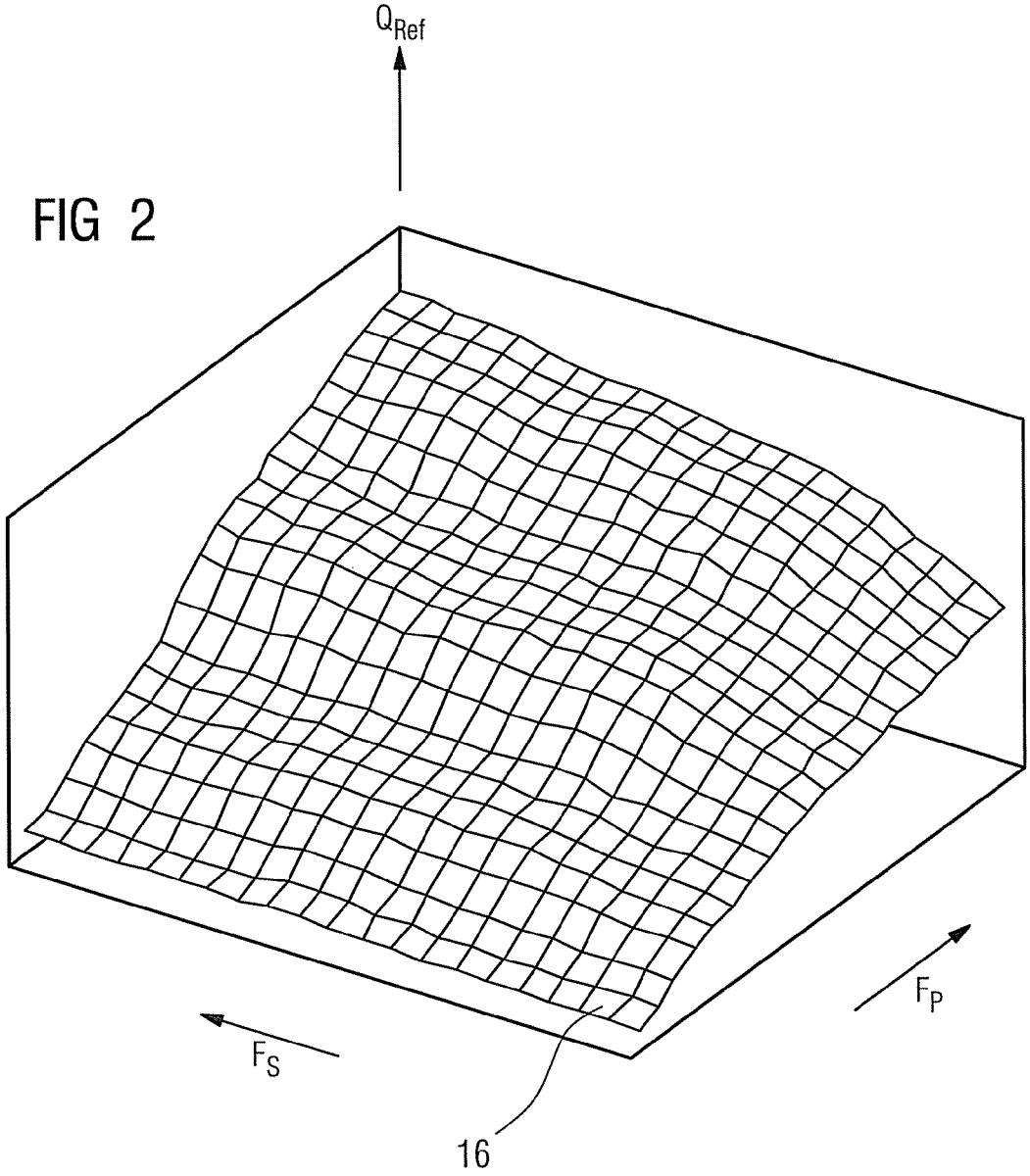
FIG. 2 shows a schematic view of a three-dimensional section through a five-dimensional characteristic diagram, generated using a process-engineering simulation program, of the quantities $F_s$, $F_P$ and $\dot{Q}_{Ref}$ at predetermined temperatures $T_{S,In}$ und $T_{P,In}$.

The output signals 3*a*, 4*a* of the flowmeters 3, 4 and the output signals 5*a*, 6*a* of the temperature sensors 5, 6 are supplied to a first characteristic diagram module 9 and a second characteristic diagram module 10. A respective high-dimensional characteristic diagram, which has been calculated by means of a process-engineering simulation program with which the heat exchanger 2 was designed or can be designed, is stored in the characteristic diagram modules 9, 10. FIG. 2 shows a three-dimensional section through five-dimensional characteristic diagram 16 stored in the characteristic diagram module 9. The characteristic diagram 16 relates to a predetermined temperature of the product medium at the first entrance $\mathbf{2}_{EP}$ of the heat exchanger 2 and a predetermined temperature of the service medium at the second entrance $\mathbf{2}_{ES}$ of the pipeline arrangement 2*b*.

Working point-dependent characteristic diagrams 16 are stored in the first characteristic diagram module 9 which relate to the clean heat exchanger 2. Characteristic diagrams which relate to the heat exchanger 2 when it as dirty as possible are stored in the second characteristic diagram module 10. As a function of the output signals 3*a*, 4*a* of the flowmeters 3, 4 and the output signals 5*a*, 6*a* of the temperature sensors 5, 6 the characteristic diagrams of the first characteristic diagram module 9 depict a heat flow which can be used as the reference heat flow of the clean heat exchanger 2. As a function of the output signals 3*a*, 4*a* of the flowmeters 3, 4 and the output signals 5*a*, 6*a* of the temperature sensors 5, 6 the characteristic diagrams of the second characteristic diagram module 10 depict a heat flow which can be used as the reference heat flow of the heat exchanger 2 which is as dirty as possible. The depicted heat flows are each supplied as an output signal 9*a*, 10*a* of the relevant characteristic diagram module 9, 10 to a monitoring module 11. In special cases, such as in the case of phase transitions inside the heat exchanger for example (evaporation, condensation), quantities other than those disclosed above may also be used as input quantities in the characteristic diagrams.

The characteristic diagram modules 9, 10 have a computer by means of which intermediate values, for which no data point is stored, are calculated by interpolation. The heat flows 9*a*, 10*a* determined by interpolation are also supplied to the monitoring module 11 in addition to the heat flows taken directly from the characteristic diagrams. The output signals 3*a*, 4*a* of the flowmeters 3, 4 and the output signals 5*a*, 6*a* of the temperature sensors 5, 6, which disclose the actual working point of the heat exchanger 2, are also supplied to the monitoring module 11. Furthermore, the output signals 7*a*, 8*a* of the third temperature sensor 7 and fourth temperature sensor 8 are also supplied to the monitoring module 11. In special cases, such as in the case of phase transitions inside the heat exchanger for example (evaporation, condensation), quantities other than those disclosed above may also be supplied to the monitoring module.

An actual heat flow can therefore be calculated in the monitoring module 11. The actual heat flow is then linked with the working point-dependent reference heat flows taken from the characteristic diagram modules 9, 10. A value between 0 and 100%, which indicates the degree of soiling of the heat exchanger 2, can be given as the output signal 11*a*.

To avoid unsteady states being taken into account in the monitoring module 11, signals $\mathbf{12}_P$, $\mathbf{13}_P$, $\mathbf{14}_P$ of the process plant 1, dependent on corresponding process parameters, are passed to control modules 12, 13, 14 which evaluate the signals $\mathbf{12}_P$, $\mathbf{13}_P$, $\mathbf{14}_P$ to ascertain whether the process plant 1 is in a steady state. If the process plant 1 is in a steady state, there is a respective signal 12*a*, 13*a*, 14*a* at the outputs of the control modules 12, 13, 14 and these are logically linked to each other in an AND gate 15. The output signal 15*a* of the AND gate 15 is applied to the monitoring module 11 as a release signal.

The invention claimed is:

1. A method of monitoring efficiency of a heat exchanger in which heat flows from a first medium into a second medium, comprising:

providing a heat exchanger;

detecting an actual heat flow in the heat exchanger;

comparing the actual heat flow with a reference heat flow corresponding to a respectively predetermined degree of soiling of the heat exchanger, the reference heat flow being stored in a storage device of a computer, wherein the actual heat flow is compared with a reference heat flow corresponding to a zero degree of soiling and a reference heat flow corresponding to an admissible degree of soiling; and determining a quality value which corresponds to a quotient from a difference between the actual heat flow and the reference heat flow corresponding to the admissible degree of soiling to a difference between the reference heat flow corresponding to the zero degree of soiling and the reference heat flow corresponding to the admissible degree of soiling.

2. The method as claimed in claim a 1, wherein the reference heat flow and the actual heat flow are based upon a same working point.

3. The method as claimed in claim 2, wherein a plurality of reference heat flows is determined at different working points and the working point of the reference heat flow corresponding to the working point of the actual heat flow is determined by interpolation.

4. The method as claimed in claim 1, further comprising:

calculating the reference heat flow by a simulation program, the simulation program being used for dimensioning the heat exchanger.

5. A device for controlling a plant, comprising:

a heat exchanger;

a storage device configured to store a characteristic diagram of a reference heat flow of the heat exchanger, and a computer configured to compare an actual heat flow in the heat exchanger with the reference heat flow, wherein the actual heat flow is compared with a reference heat flow corresponding to a zero degree of soiling and a reference heat flow corresponding to an admissible degree of soiling, and configured to determine a quality value which corresponds to a quotient from a difference between the actual heat flow and the reference heat flow corresponding to the admissible degree of soiling to a difference between the reference heat flow corresponding to the zero degree of soiling and the reference heat flow corresponding to the admissible degree of soiling.

6. The device as claimed in claim 5, wherein characteristic diagrams of reference heat flows corresponding to more than ten different working points are stored in the storage device.

7. The device as claimed in claim 5, wherein characteristic diagrams of reference heat flows corresponding to at least two different degrees of soiling are stored in the storage device.

8. The device as claimed in claim 5, wherein characteristic diagrams of reference heat flows corresponding to more than ten different working points and at least two different degrees of soiling are stored in the storage device.

9. A non-transitory computer readable medium storing a computer program, wherein the computer readable medium has program code sequences that, when executed on a computer, performs a method, comprising:

detecting an actual heat flow in a heat exchangers;

comparing the actual heat flow with a reference heat flow corresponding to a predetermined degree of soiling of the heat exchanger, wherein the reference heat flow is stored in a storage device of the computer; and determining a quality value which corresponds to a quotient from a difference between the actual heat flow and the reference heat flow corresponding to an admissible degree of soiling to a difference between a further reference heat flow corresponding to a zero degree of soiling and the reference heat flow corresponding to the admissible degree of soiling.

10. The non-transitory computer readable medium as claimed in claim 9, wherein the reference heat flow and the actual heat flow are based upon a same working point.

11. The non-transitory computer readable medium as claimed in claim 10, wherein a plurality of reference heat flows is determined at different working points and the working point of the reference heat flow corresponding to the working point of the actual heat flow is determined by interpolation.

12. The non-transitory computer readable medium as claimed in claim 9, the method further comprising:

calculating the reference heat flow by a simulation program, the simulation program being used for dimensioning the heat exchanger.

* * * * *